United States Patent [19]

Dalquist, III et al.

[11] Patent Number: 5,040,950

[45] Date of Patent: Aug. 20, 1991

[54] POWER WASHING APPARATUS

[75] Inventors: H. David Dalquist, III, Minnetonka; Glenn M. Campbell, Sr.; Glenn M. Campbell, Jr., both of Plymouth; Gary R. Everson, Orono; Lloyd G. Keleny, Champlin; Douglas J. Kluge, Golden Valley; Paul M. Varley, Dundas, all of Minn.

[73] Assignee: Northland Aluminum Products, Inc., Minneapolis, Minn.

[21] Appl. No.: 390,220

[22] Filed: Aug. 7, 1989

[51] Int. Cl.[5] ..... F04C 2/04; F04B 17/06

[52] U.S. Cl. ..... 417/234; 417/366; 417/422; 417/371; 418/15; 418/77; 418/206

[58] Field of Search ..... 417/44, 234, 366, 422, 417/371, 18, 423.1, 423.3, 423.14; 418/15, 77, 206; 239/532, DIG. 22, 310

[56] References Cited

U.S. PATENT DOCUMENTS

| | | | |
|---|---|---|---|
| 2,554,191 | 5/1951 | Huber | 417/423.3 |
| 2,763,214 | 9/1956 | White | 417/357 |
| 3,015,283 | 1/1962 | Knipp | 418/15 |
| 3,207,444 | 9/1965 | Kelly et al. | 239/310 |
| 4,013,225 | 3/1977 | Davis | 239/532 |
| 4,015,828 | 4/1977 | Miles | 418/15 |
| 4,195,970 | 4/1980 | Zalis | 417/269 |
| 4,480,967 | 11/1984 | Schulze | 417/371 |
| 4,778,354 | 10/1988 | Idei | 417/366 |
| 4,790,454 | 12/1988 | Clark et al. | 239/310 |
| 4,810,169 | 3/1989 | Kränzle | 417/234 |
| 4,824,340 | 4/1989 | Bruggemann et al. | 417/566 |
| 4,861,231 | 8/1989 | Howard | 417/38 |
| 4,926,904 | 5/1990 | Polk et al. | 137/565 |

FOREIGN PATENT DOCUMENTS

| | | | |
|---|---|---|---|
| 0791990 | 12/1980 | U.S.S.R. | 418/206 |

*Primary Examiner*—Leonard E. Smith
*Assistant Examiner*—David W. Scheuermann
*Attorney, Agent, or Firm*—Haugen and Nikolai

[57] ABSTRACT

A portable, high-pressure, power washing system is described which includes an electric motor driven gear pump where the electric motor is effectively water cooled by virtue of being contained in a thermally conductive housing surrounded by an insulating water jacket through which the water being pumped is made to flow before reaching the pump's inlet port. The pump is driven through a gear reduction mechanism such that a relatively inexpensive, single-phase, series AC (universal) motor normally operating at a high rpm can be employed. By proper dimensioning of the pump chamber relative to the drive and idler gears and by providing a flow divider at the pump chamber's discharge orifice, high pumping efficiency is obtained. Completing the assembly is a discharge wand for directing the high pressure water at the surface to be cleaned and for controlling the on/off state of the pump's drive motor.

12 Claims, 5 Drawing Sheets

POWER WASHING APPARATUS

BACKGROUND OF THE INVENTION

I. Field of the Invention

This invention relates generally to fluid handling systems and more particularly to a low cost, portable, high pressure washing system for residential and light commercial use.

II. Discussion of the Prior Art

Systems for pumping water from a municipal supply at high pressures and reasonable flow rates have, in the past, typically required multi-cylinder piston, reciprocating pumps driven by an electric motor of several horsepower. Such an arrangement tends to be quite heavy and it has been the practice in the past to mount the pump and motor on a wheeled cart to facilitate its movement around a worksite. Moreover, the cost of such a motor/pump/cart combination tends to place such a high pressure washer out of the reach of many homeowners who may wish to use high pressure water, e.g., 500 psi, for garage cleanup, car washing and other similar household tasks. When attempts are made to cost-reduce commercial/industrial pumping equipment for such household application, the reliability of the resulting product has tended to suffer. Also, when water is being sprayed in the vicinity of an electric motor, often by untrained individuals, there is a serious risk of personal injury due to electric shock.

OBJECTS

It is accordingly a principal object of this invention to provide an improved, high-pressure washer system.

Another object of the invention is to provide a high pressure washing system capable of delivering a water stream at a flow rate in excess of 3.5 GPM and at a pressure of 500 psi or more and which is light in weight, less than 10 pounds and which can be manufactured at relatively modest cost, but without a sacrifice in reliability.

Still another object of the invention is to provide a high pressure washing system which is totally shielded by an insulating shroud and safe to operate in a wet environment.

SUMMARY OF THE INVENTION

The problems attendant in the prior art portable high pressure washing systems outlined above are obviated by constructing a unitary motor/rotary pump combination in which a relatively small, high-speed, universal A.C. electric motor capable of operating about 25,000 rpm when unloaded, is coupled to the pump's shaft through a speed-reducing planetary gear mechanism. The electric motor is mounted totally within the confines of a sealed aluminum housing which exhibit high thermal conductivity. Surrounding this motor housing and spaced therefrom is a rugged molded plastic jacket. The water to be pumped is made to flow from the inlet connection, through and around the annular space between the outer plastic jacket and the aluminum motor housing before entering the pump's inlet port. In this way, the heat generated by the motor transfers through the aluminum housing and is carried away by the water being pumped, thus preventing overheating of the motor even though, as mentioned, it is totally sealed within the motor housing.

The motor's shaft passes through a liquid tight seal in the aluminum housing to drive the sun gear of a planetary gear system, the internal ring gear of which is held stationary within an integrally formed cup formed one end of the aluminum motor housing. The planet gears are journaled in a three-arm spider which, in turn, is coupled to the pump's drive shaft.

The pump itself comprises a molded plastic pump housing having first and second intersecting bores for receiving a drive spur gear and an idler spur gear therein. It is the drive gear that is driven by the planetary gear mechanism at a speed of about 4000 rpm and water is picked up at a specially configured inlet port between the gear teeth and carried to the pump's outlet port with the pressure being multiplied in the process the meshing action of the gears and the centrifugal pumping action brought about by the relatively high operating speed in progressing from the pump's inlet to its outlet. The pump chamber includes a novel arrangement of actuate pockets and a flow divider associated with the inlet to the pumping chamber to limit any cavitation action which would otherwise occur and to create a more laminar flow between the walls of the pumping chamber and the periphery of the drive and idler gears.

The high pressure flow feeds through a discharge housing and a suitable hose connection to a control wand. A pneumatic control actuated by the wand's trigger allows the pump motor to be energized only when the pump's inlet water pressure is sufficient to insure that flow will be adequate to maintain the necessary cooling and that the wand trigger is being squeezed.

The foregoing features and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
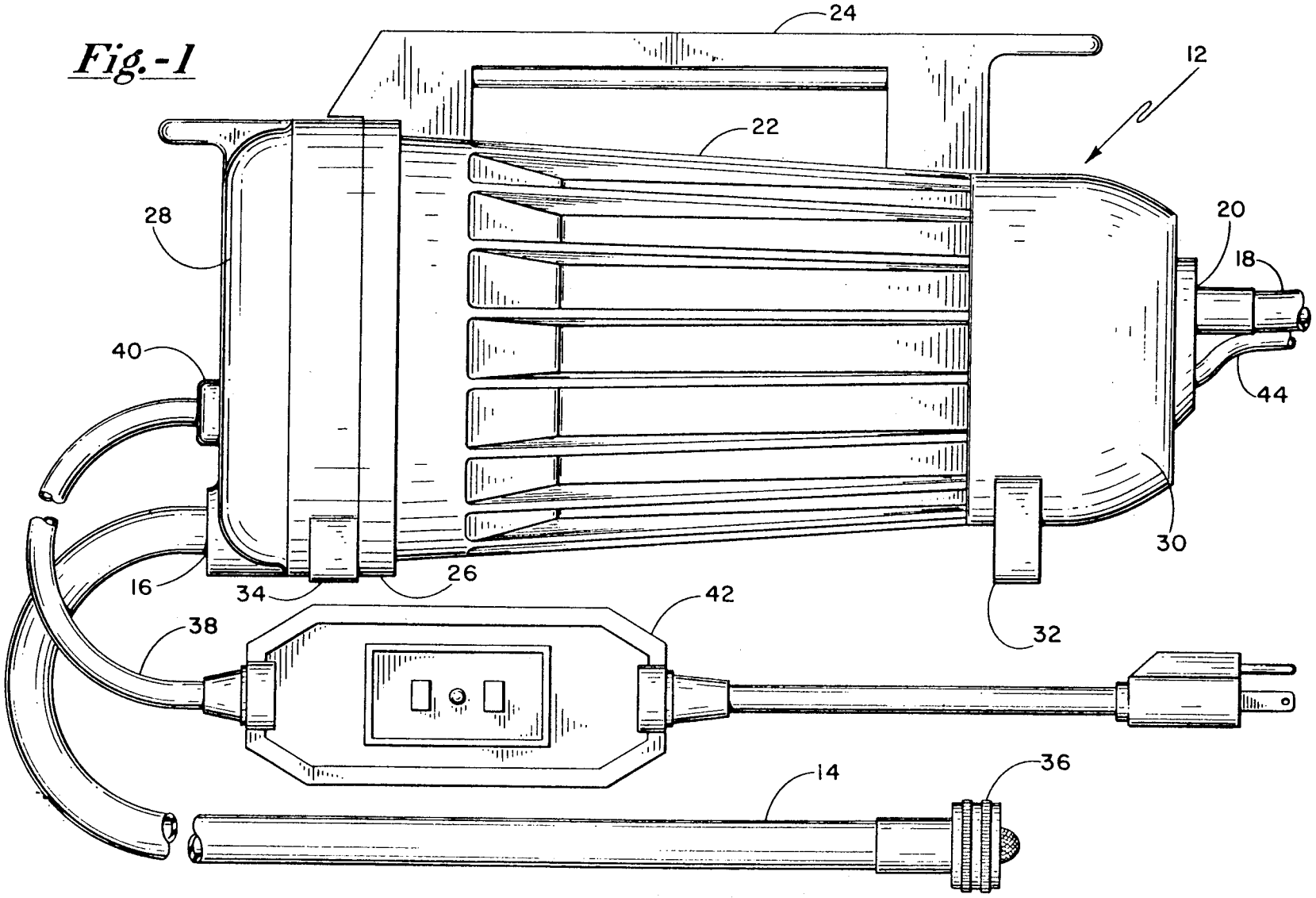
FIG. 1 is a side elevation of the pump portion of the high pressure power washing system of the present invention.

Referring first to FIG. 1, there is illustrated a side elevational view of the pump assembly used in the pump assembly used in the high pressure power washer of the present invention. It includes an electric motor driven pump assembly indicated generally by numeral 12. It has a low pressure liquid inlet hose 14 coupled to its inlet port 16 and a high pressure outlet hose 18 coupled to the pump's discharge port 20. The high pressure discharge hose 18 is connected to a hand-held wand assembly which is more particularly depicted in the side elevational view of FIG. 5.

The pump assembly 12 is seen to include an outer molded plastic, electrically insulating water jacket 22 having a carrying handle 24 affixed thereto. Secured by elongated bolts (not shown) to the rear end of the water jacket 22 is a control housing 26 which, in turn, is enclosed by a control cover member 28. Likewise, the forward end of the water jacket 22 has a discharge cover member 30 secured to it. Integrally molded on the plastic discharge cover 30 are legs as at 32. Likewise, the control cover 28 is equipped with integrally molded legs, as at 34, and dimensioned such that they cooperate with the legs 32 to support the pump assembly 12 in a generally horizontal disposition when placed on level ground.

With continued reference to FIG. 1, the inlet hose 14 is equipped with a female coupling 36 allowing its attachment to a garden hose or plumbing faucet. Electric power for driving the pump's motor is applied by way of a cord 38 which passes through a strain relief member 40 to the interior of the control housing 26. Placed in series in the cord 38 is a conventional ground fault indicator and reset circuit 42. The circuit acts as a safety device to prevent the user from electrical shock in the highly unlikely event that the pump's electrical ground circuit should open.

In addition to the pump's discharge hose 18, a further pneumatic tube 44 passes through an opening in the forward face of the discharge cover 30 and is ultimately routed to a water pressure monitor and pressure switch contained within the control housing 26. The pressure monitor and pressure switch work together to insure that the pump motor will only operate when the discharge trigger on the wand is squeezed and the inlet liquid supply is at a predetermined minimum pressure. The construction and mode of operation of the control mechanism will be described in greater detail below.

Figure 2:
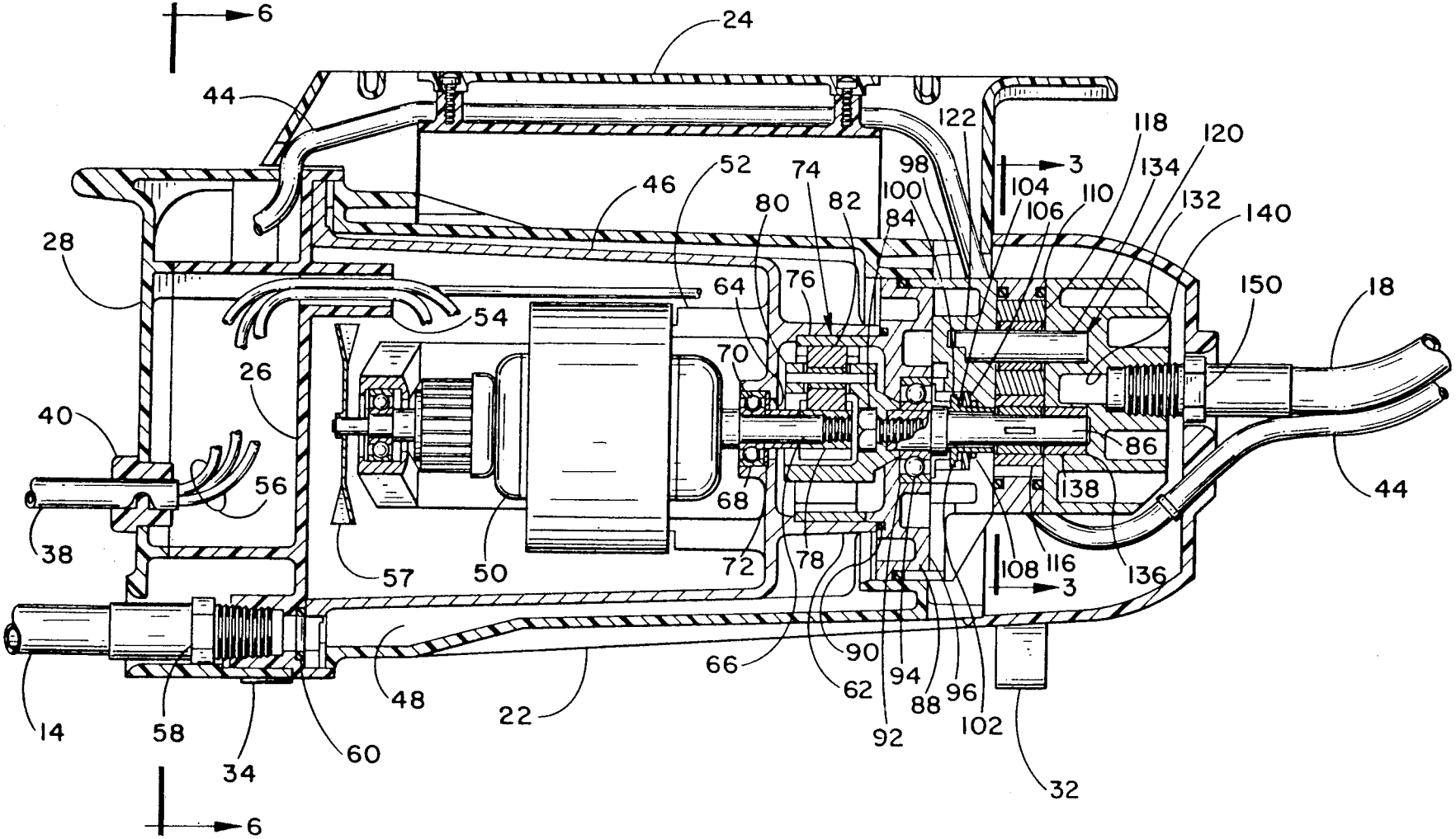
FIG. 2 is a longitudinal cross-section taken through the center of the pump assembly of FIG. 1.

Having described the overall exterior features of the pump assembly in general terms for the purpose of orienting the reader, consideration will next be given to the more specific constructional details of the pump assembly 12, and, in this regard, reference is made to the longitudinal, vertical cross-sectional view of FIG. 2. As seen in FIG. 2, the outer molded plastic water jacket 22 surrounds a molded metal (aluminum) motor housing 46 with an annular clearance space 48 therebetween. The motor housing 46 has the general shape of a truncated cone and has a hollow interior. Supported therein by brackets 52 is an AC electric motor 50 which is generally centered within the interior of the housing 46. The motor 50 is preferably a relatively inexpensive high-speed, Series A.C. Universal motor of the type commonly used in portable power equipment, such as vacuum cleaners, circular saws, etc.

The motor housing 46 is closed off at its rear end by the control housing 26, except for a tubular port 54 through which the electrical wires 56 in the cord 38 pass to provide electrical feed for the motor 50. A fan 57 on the motor's shaft circulates the air within the interior of housing 46. With continued reference to FIG. 2, it is to be observed that the liquid inlet hose 14 joins to a fitting 58 leading to the annular chamber 48. An 0-ring seal 60 disposed between the motor housing 46 and the control housing 26 prevents leakage of the liquid to be pumped into the hollow interior of the motor housing 46. As such, the heat generated by the electrical motor passes through the aluminum housing 46 which is a good thermal conductor, and is carried away by the liquid being pumped. In this way, there is no harmful build-up of heat within the motor housing which could otherwise adversely affect the operation of the pump assembly.

The forward end of the motor housing 46 has an exterior, integrally molded cup portion 62 with a central bore 64 passing therethrough for receiving the motor's output shaft 66. A counterbore as at 68 is also formed in the end of the motor housing 46 for receiving a set of ball bearings 70 and a resilient expansion washer 72 therein. In this fashion, the motor's output shaft 66 is journaled for rotation in the motor housing 46.

A universal alternating current electric motor of the type used herein may typically operate in the range of from 16,000 rpm to 28,000 rpm. Thus, a suitable gear reduction mechanism, indicated generally by numeral 74, is employed to ultimately drive the pump itself. The gear reduction mechanism 74 preferably comprises a planetary gear system, including an outer ring gear 76 held stationary within the cup portion 62 of the motor housing 46, an inner sun gear 78 driven by the motor's shaft 66 and a three arm spider 80 which journals three planetary spur gears, as at 82, therein. The spur gears mesh with the internal ring gear 76 while the spider 80 is fitted onto a bolt 84 to which the pump shaft 86 is secured. Using this arrangement, the rpm of the motor is stepped down by a factor of four, causing the pump shaft 86 to rotate, when driven, at a speed of from 4,000 to 7,000 rpm.

Juxtaposed with the front edge of the cup 62 is a bearing housing member 88 which is preferably molded from glass filled Noryl and is sealed to the leading edge of the cup portion 62 by a 0-ring 90 so as to preclude the liquid flowing in the annular chamber 48 from permeating into the gear reduction mechanism 74 and deleteriously affecting the lubrication provided for the planetary gear reduction assembly. The bearing housing 88 includes a counterbore 92 which receives a bearing set 94 therein for journaling the pump shaft 86.

Fitting over the cylindrical forward end portion 96 of the bearing housing 88 is a molded plastic seal housing member 98 which includes a central opening into which is fitted a seal body member 102, wave Washers 104 and a seal retaining ring 106. Finally, a 0-ring 108 surrounds the seal body and fits into an annular recess in the seal housing 98 so as to preclude the liquid being pumped from flowing into the interior of the seals and compromising their effectiveness.

The portion of the shaft 86 exiting the seal housing 98 next enters the pump housing 110. It, too, may be molded from a glass-filled Noryl plastic and, as shown in the detailed view of FIG. 3, includes first and second intersecting gear-receiving bores 112 and 114 defining the pumping chamber. A pump drive spur gear 116 is keyed to the shaft 86 and fits within the gear-receiving bore 114 and its teeth mesh with the pump idler spur gear 118 which is journaled for rotation on a polished steel shaft 120 fitted into a socket-like bore 122 formed in the seal housing 98.

With reference again to FIG. 3, the distance between the centers 122 and 124 of the bores 112 and 114 is equal to the sum of the radii of the pitch circles of the spur gears 116 and 118. The liquid to be pumped is brought through longitudinally aligned ports formed in the bearing housing 88 and the seal housing 98 and into the inlet ports 126 and 128 so as to flood space between the spur gears 116 and 118 in the inlet area of the pump housing. As the drive gear 116 and the idler gear 118 rotate in the direction of the arrows in FIG. 3, the liquid filling the teeth is carried away from the lobe-like pockets 126 and 128 symmetrically arranged with respect to the inlet port formed in the bearing housing 88 when the bearing housing is juxtaposed with the pump housing. A flow divider 130 is provided in the pump housing 110 directed at the midpoint of an imaginary line joining the centers of the gear receiving bores 112 and 114 which assists in creating a laminar flow of the water as it flows into the space between the periphery of the gears and the wall of the pumping chamber.

Referring momentarily to FIG. 2 again, juxtaposed with the forward surface of the pump housing 110 is the discharge housing member 132. The discharge member is also preferably molded from glass-filled Noryl plastic and includes a bore 134 for receiving the end portion of the idler gear shaft 120 as well as a bore 136 for receiving the pump shaft bearing 138. The discharge housing also includes a discharge port 140 which is precisely aligned with the high pressure side of the pump when the discharge housing is in abutting relationship to the pump housing.

Figure 3:
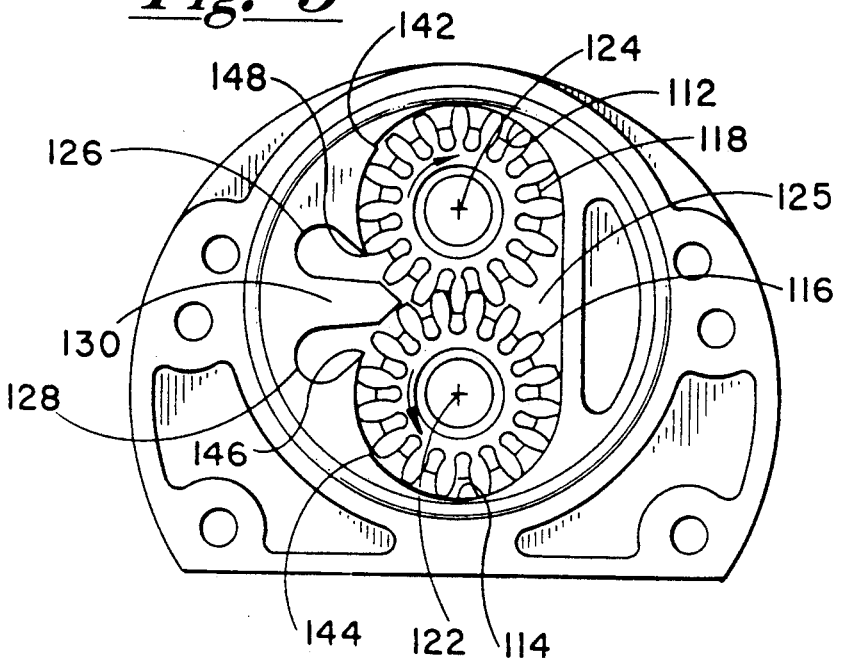
FIG. 3 is a cross-sectional view taken along the lines 3—3 in FIG. 2.

As seen in FIG. 3, the radius of the gear receiving bores 112 and 114 are stepped at 142 and 144 such that a greater clearance exists between the periphery of the pump gears 116 and 118 and the cylindrical walls of the pumping chamber on the outlet side and a lesser clearance exists at the inlet side. This serves to relieve contact on the gear surface to thereby reduce the load. The lesser diameter segment between the lead lines 142–148 and 144–146 comprises a seal area where the pressure is developed. The high pressure created as the gears rotate produces a force against the gear shafts 122 and 124 to normally urge the gears toward the left when viewed as in FIG. 3. This enhances the sealing action between the rotating gears and the chamber walls. As the shafts 122 and 124 as well as their journals wear, self-compensation takes place maintaining the integrity of the seal area.

In that the gears 122 and 124 are arranged to be driven at a speed in excess of 4,000 rpm, the device not only functions as a gear pump, but it also produces a centrifugal pumping effect. A substantial kinetic energy is imparted to the water which converts to potential energy as the direction of flow turns and exits the discharge port.

The trailing edges 146 and 148 of the pockets 126 and 128 as well as the leading edges formed on the diffuser member 130 have a significant relationship to the overall efficiency of the pump. The pockets 126 and 128 along with the flow divider 130 function to create a laminar flow of liquid flowing through the inlet port in the bearing housing and filling the pockets 126 and 128 as it enters the pumping chamber, being carried by the moving gears. The flow divider 130 is positioned with its tip located at the point where the mating teeth on the idler spur gear and the drive spur gear open up to expose a vacant chamber. This reduces cavitation effects as liquid tries to rush into the void.

At the speed at which the pump is driven, and because of the clearances provided between the faces of the gear teeth and the walls of the gear-receiving bores defining the pumping chamber, the gears tend to act both as a centrifugal pumping elements and as a gear pump. This tends to increase the flow capacity of the pump in terms of its gallons-per-minute rating.

Figure 4:
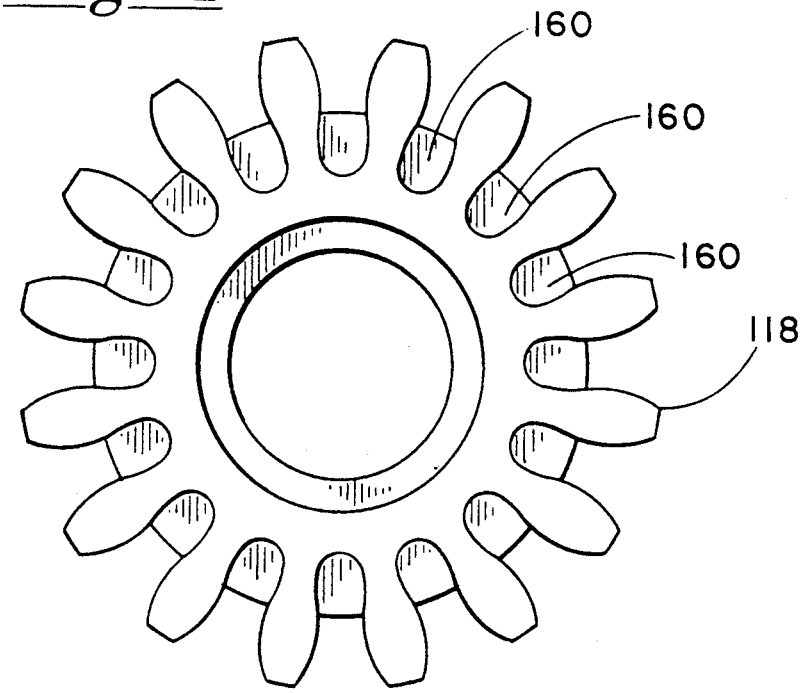
FIG. 4 is an enlarged detailed drawing of the pump drive gear shown in FIG. 3.

FIG. 4 is a plan view of the pump drive gear 116 or the pump idler gear 118. It is to be particularly noted that the side surfaces of the base cylinder from which the gear teeth project are relieved in the space between the teeth as at 160 to create a pocket into which the liquid being pumped may flow to effectively float the gears relative to the exterior surface of the seal housing 98 and the interior surface of the discharge housing 132. This reduces frictional wear on the mating surfaces of the gear sides and the bearing housing and discharge housing.

The discharge hose 18 has a fitting 150 which screws into a threaded bore formed in the pump discharge housing and which is in fluid communication with the port 140.

Figure 5:
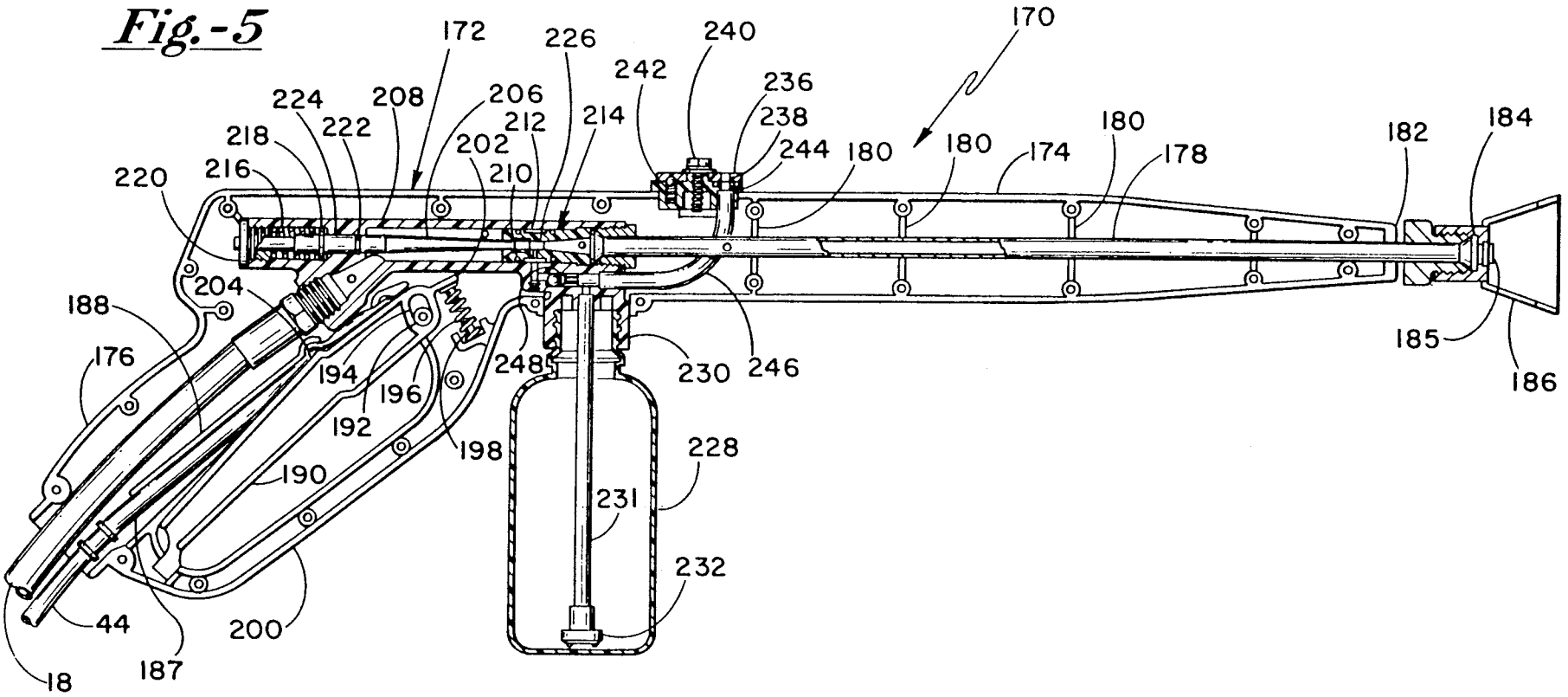
FIG. 5 is a side cross-sectional view of the control wand designed for use with the pump assembly of FIG. 1.

In high pressure washing applications, it is convenient to discharge the high pressure liquid stream through a hand-held wand so that the stream can be focused on a surface to be sprayed. FIG. 5 is a cross-sectional view of such a wand, especially designed for use with the high pressure pump assembly of FIG. 1. The wand assembly is shown in cross-section so as to reveal its inner workings. The wand is indicated generally by numeral 170 and is seen to be pistol-shaped and includes a molded plastic shroud 172 including a barrel portion 174 and a pistol grip portion 176. Supported within the barrel portion 174 is a stainless steel tube 178 which is effectively clamped between integrally molded reinforcing ribs 180 formed internally of the front and back halves of the wand 172. Only the back half is shown. The discharge end of the tube 178 projects outwardly from the molded plastic barrel portion 174 as at 182 and the end thereof is flared as at 184 to accept a nozzle 185 having a mating conical segment for cooperating with the flared end 184 of the tube 178. The nozzle 185 produces a desired spray pattern in the liquid as it is discharged. A molded plastic protective hood 186 in the form of a flared basket attaches to the nozzle fitting to prevent the discharge orifice from inadvertently becoming clogged with mud or other debris during use. Also, the basket tends to establish a minimum safe distance between the discharge orifice and any body part of the user so that the likelihood of serious injury due to the impingement of the high pressure liquid is minimized.

The discharge hose 18 is fed through an opening in the base of the handle 176. Likewise, the pneumatic control tube 44 also feeds through the base of the pistol grip portion 176 and joins to a soft, flexible, elastomeric tube 187 which extends through a guide 188. An elongated trigger member 190 is hinged by a pin 192 passing through a slot 194 in the forward end thereof and a compression spring 196 is disposed between a spring cup 198 forming a part of the trigger guard 200 of the pistol grip 176. The other end of the compression spring 196 cooperates with a finger 202 projecting from the trigger 190 to normally bias the trigger 190 outward or away from the compressible tube 187. The end of the flexible tube 187 is normally open such that atmospheric pressure exists within the lumen of the tube 187 and the tube 44 when the trigger is released. When the trigger 190 is squeezed, however, rounded projection 204 formed on the trigger 190 first comes into play to initially pinch off the open end of flexible tube 187. Then, as the trigger 190 is continued to be squeezed, the flexible tube 187 is compressed to thereby send a pneumatic pressure signal to a air-operated switch contained within the control housing 28 of the pump assembly.

The open-ended tube 187 which becomes pinched off as a means of producing the pneumatic signal offers a significant advantage over a sealed system. In a sealed system, if an air leak develops and it becomes depressurized, the control will no longer operate. In the apparatus disclosed herein, the tube becomes recharged with air each time the trigger is actuated. As will be later described, the pneumatic signal will initiate operation of the electric motor 50 if, and only if, the liquid pressure within the annular chamber 48 exceeds about 30 psi as a minimum. This will insure that adequate cooling water is available to maintain the temperature within the motor housing to a safe level. The details of how the air-controlled switches are arranged will be set forth in greater detail later on in this specification.

The flow of high pressure water through the stainless steel tube 178 and out the nozzle 185 is controlled by a poppet valve assembly which includes a shut-off rod 206 which is constrained for reciprocating movement within a valve housing 208. The forward end of the shut-off rod 206 includes an annular taper 210 which cooperates with a sleeve 212 fitted into a venturi aspirator body 214. The shut-off rod 206 is normally biased to this closed position by a compression spring 216 which cooperates with a flange 218 affixed to the shut-off rod and a threaded plug 220 fitted into the end of the valve body 208. The threaded plug 220 is used to establish or adjust the force exerted by the spring 216 on the shut-off rod 208.

An 0-ring 222 fits within an annular groove formed in the shut-off rod 206, effectively creating a piston area at 224 within the valve body 208. Normal household pressure in the line 18 is insufficient to overcome the biasing force of the spring 216 such that the valve 210 remains seated in the sleeve 212, blocking the flow of water through the tube 178. When the pump is being driven by its motor to create a pressure in excess of 150 PSI, the shut-off rod is moved to the rear against the force of the biasing spring 216 to unseat the valve area 210 from its position against the sleeve 212. The high pressure water then flows through the bore 226 formed in the aspirator body 214 and thence out the discharge tube 178 and its nozzle 185.. When the trigger 190 is released to again open the compressible tube 187 and exposing the pneumatic pressure switch 250 to atmospheric pressure, the pump motor 50 is shut off and the pressure in the discharge line 18 suddenly drops. This allows the spring 216 to again move the shut-off rod forward to block the flow of water through the wand.

In certain applications, it may be desirable to introduce a chemical, e.g., soap solution, into the water stream being sprayed out the end of the wand. The soap dispensing assembly and control therefore is located on the discharge wand which affords two advantages. First, it obviates the need to walk back to the place where the pump is set to turn the chemical supply on and, secondly, there is no appreciable delay between the time that the chemical source is turned on or off and the time that the water exiting the wand reflects this change. The liquid concentrate is contained within a bottle 228 which is adapted to be screwed into a threaded fitting 230 on the valve body 208 retained by the molded plastic barrel 174. A length of tube 231 extends to the bottom of the bottle 228 and may include a filter screen as at 232. The other end of the tube 231 connects to a socket in the base of the valve body 208 surrounded by the threaded fitting 230. Disposed above the top of the barrel 174 is a rotatable dial 236 having a series of holes as at 238 of differing diameter centered radially about a pivot screw 240. A spring-ball detent 242 provides a means of centering any one of the radial holes, such as 238, relative to a bore 244 which is centered relative to the lumen of a further tube 246 leading to yet a further socket in the valve body 208. Thus, by turning the dial 236, the operator can ratio the amount of air being drawn through the tube 246 to offset the vacuum being drawn by the venturi or aspirator 214. The soap dial mechanism 236 thus proportions the amount of liquid being drawn from the bottle 228.

Disposed in the line is a ball-check valve 248. When the high velocity stream is passing through the throat of the venturi, a negative pressure is created and the liquid chemical is drawn up through the tube 230 in the bottle 228 to open the ball valve 248 and allow that liquid chemical to pass into the water stream. Should the nozzle output become restricted, the resulting increase in pressure forces the ball valve 248 closed to prevent the influx of water into the bottle which would serve to dilute the concentrate contained therein.

Figure 6:
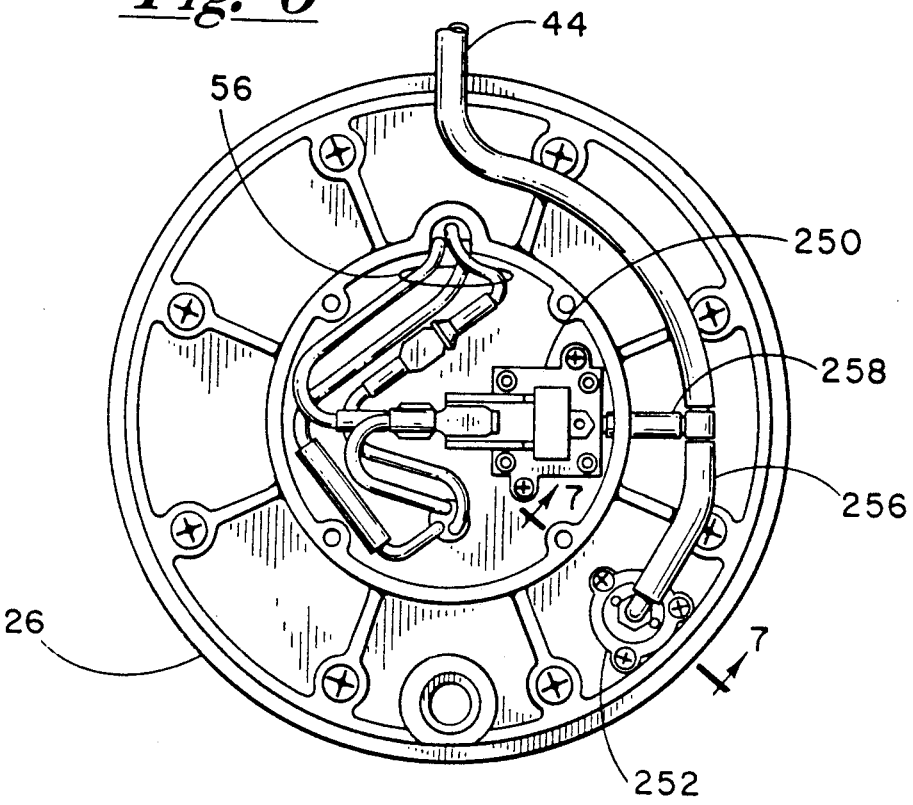
FIG. 6 is a cross-sectional view taken along the line 6—6 in FIG. 2.
Figure 7:
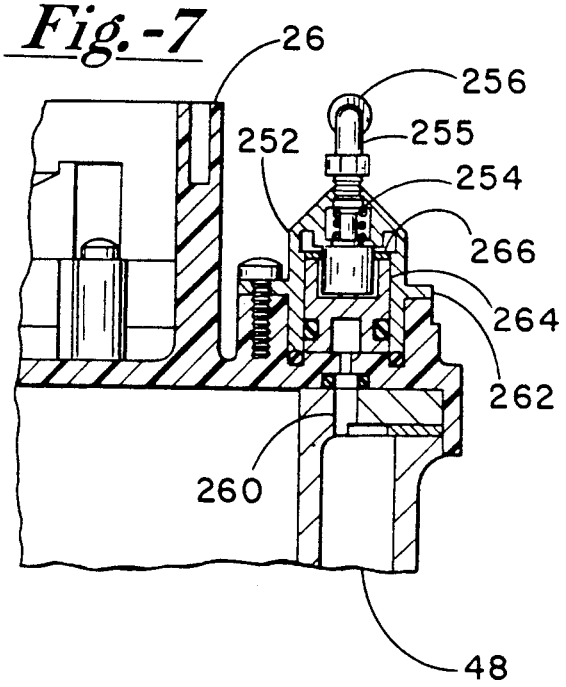
FIG. 7 is a cross-sectional view taken along the line 7—7 in FIG. 6.

Referring next to FIG. 6, it comprises a cross-sectional view taken along the line 6-6 in FIG. 2 and shows the interior enclosed by the control cover 28. Mounted within the control housing is a pressure switch 250 which is arranged to sense the pressure within the control line 44 and to electrically connect the power to the pump motor 50 when a pneumatic signal is delivered to it via the control tube 44. It will be recalled at this point that actuation of the trigger 190 on the wand assembly normally results in an increase in the pressure in the line 44 sufficient to actuate the pressure switch 250, provided that water is being applied to the pump assembly 12 via the inlet hose 14. To satisfy this latter condition, there is provided a water pressure sensor 252, the details of which are shown in FIG. 7. The water pressure sensor is seen to include a valve stopper 254 which, when open, maintains atmospheric pressure in the tube 256 coupled to the air inlet tube 258 (FIG. 6) of the pneumatically actuated switch 250. Thus, when the valve stopper 254 is open, the pneumatic signal developed in line 44 is ineffective to actuate switch 250.

The valve stopper 254 is in fluid communication with the water jacket 48 (FIG. 2) via port 260 and includes an outer housing 262 in which is inserted a piston 264 which is normally urged by a spring to it open position relative to the orifice of a lumen in the elbow 255. This maintains the line 256 at atmospheric pressure. It is only when the water pressure within the water jacket 48 reaches about 30 psi that the piston 264 will move the stopper 254 to close off the tube 256. Now, when the trigger 190 is depressed to clamp off the compressible tube 187 and then squeezed against it, the pressure within the line 44 increases to the point that the switch 25 will actuate to connect electrical power to the pump motor. This insures that adequate cooling water will be flowing in the water jacket to carry away the heat generated by the motor and to lubricate the pump surfaces, thus precluding failure of the motor and its bearings due to over-heating.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A portable pumping apparatus for high-pressure washing application comprising, in combination:

(a) an outer, electrically insulating shroud having a liquid inlet port and a liquid outlet port;

(b) an inner, single-wall, liquid impervious, motor housing having a hollow interior and generally concentrically disposed within said outer shroud and formed from a material exhibiting high thermal conductivity characteristics, said outer shroud and inner, single-wall motor housing being spaced to define an annular chamber therebetween and joined along a mating interface to seal said hollow interior;

(c) electric motor means supported entirely within said hollow interior of said motor housing and totally isolated from liquid being pumped, said motor means having an output shaft;

(d) a transmission housing integrally formed on the exterior of said inner housing and concentrically disposed about said output shaft of said motor;

(e) speed reducing gear means disposed within said transmission housing and coupled to be driven by said output shaft of said motor;

(f) gear pump means coupled to be driven by said speed reducing gear means at a speed which is substantially less than said output shaft of said motor, said gear pump means including a pumping chamber, an inlet port in fluid communication with said annular chamber and said pumping chamber and a pumping chamber outlet port in fluid communication with said pumping chamber; and (g) means for introducing a liquid to be pumped through said liquid inlet port in said shroud to flood said annular chamber while flowing said liquid through said inlet port of said gear pump means into said pumping chamber whereby heat produced by said electric motor is conducted through said inner motor housing and carried away by said liquid being pumped.

2. The portable pumping apparatus as in claim 1 wherein said gear pump means comprises:

(a) pump housing means including a plate member having first and second intersecting gear receiving bores extending through the thickness dimension thereof to define said pumping chamber, the centers of said bores being spaced apart by a predetermined distance, and inlet divider flow means projecting inwardly of said first and second gear receiving bores midway of said predetermined distance for limiting cavitation proximate said inlet port (b) a driven pump gear disposed in said gear receiving bore and coupled to said speed reducing gear means;

(c) an idler pump gear disposed in said second gear receiving bore, said predetermined distance corresponding to the sum of the radii of the pitch circles of said driven gear and said idler gear; and (d) pump discharge housing means juxtaposed with said pump housing means and including a discharge port positioned to receive the liquid being pumped from said pumping chamber through said pump chamber outlet port.

3. The portable pumping apparatus as in claim 2 wherein said inlet divider means includes:

(a) first and second arcuate pockets formed in said pump housing, each having a leading edge and a trailing edge oriented tangent to said first and second intersecting gear receiving bores; and (b) flow dividing means separating said first and second pockets and aligned perpendicular to an imaginary line joining the centers of said first and second gear receiving bores and at the midpoint of said imaginary line.

4. The portable pumping apparatus as in claim 1 wherein said first and second gear receiving bores each include a circumferential segment of a first radius and a contiguous circumferential segment of a second radius greater than said first radius.

5. The portable pumping apparatus as in claim 2 wherein said driven pump gear and said idler pump gear are spur gears whose teeth include indented recesses on at least one side edge surface thereof to capture a fraction of the liquid being pumped for creating a liquid bearing between said spur gears and said pump discharge housing.

6. The portable pumping apparatus as in claim 2 wherein said driven pump gear is driven at a speed in the rage of from 4,000 to 8,000 rpm.

7. The portable pumping apparatus as in claim 1 and further including control wand means coupled by a hose to said pumping chamber outlet port, said control wand including a tubular barrel, a poppet valve disposed between said tubular barrel and said hose and biased to a normally closed, fluid-blocking position, said poppet valve opening only when the pressure in said hose exceeds a predetermined threshold.

8. The portable pumping apparatus as in claim 7 and further including a pneumatic actuated electric switch connected in circuit with said electric motor means; and means coupled to said switch for disabling said switch when the water pressure within said annular chamber falls below a predetermined lower threshold pressure valve.

9. The portable pumping apparatus as in claim 8 and further including means located in said control wand for producing a pneumatic signal for said pneumatic actuated electric switch.

10. The portable pumping apparatus as in claim 9 wherein said means located in said control wand for producing a pneumatic signal comprises a trigger member and a flexible, compressible tube cooperating with said trigger member, said flexible, compressible tube being in fluid communication with said pneumatic actuated electric switch.

11. The portable pumping apparatus as in claim 10 wherein said flexible, compressible tube has an open end for normally maintaining said switch at atmospheric pressure and said trigger includes means for pinching said open end closed as it is squeezed against said flexible compressible tube.

12. The portable pumping apparatus as in claim 7 and further including a venturi aspirator means disposed downstream of said poppet valve; a chemical concentrate container affixed to said control wand means; an open-ended tube disposed within said container and coupled to said venturi aspirator means; and selector means mounted on said control wand for controlling the rate at which liquid chemical concentrate is drawn from the container.

* * * * *